US008678610B2

(12) United States Patent
Simon et al.

(10) Patent No.: US 8,678,610 B2
(45) Date of Patent: Mar. 25, 2014

(54) INDEPENDENT MODULES FOR LED FLUORESCENT LIGHT TUBE REPLACEMENT

(71) Applicant: iLumisys, Inc., Troy, MI (US)

(72) Inventors: David L. Simon, Grosse Pointe Woods, MI (US); John Ivey, Farmington Hills, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

(21) Appl. No.: 13/858,223

(22) Filed: Apr. 8, 2013

(65) Prior Publication Data

US 2013/0223052 A1 Aug. 29, 2013

Related U.S. Application Data

(63) Continuation of application No. 13/173,762, filed on Jun. 30, 2011, now Pat. No. 8,454,193.

(60) Provisional application No. 61/362,504, filed on Jul. 8, 2010.

(51) Int. Cl.
*F21S 4/00* (2006.01)

(52) U.S. Cl.
USPC ..... 362/217.02; 362/249.02; 362/217.08; 362/217.13

(58) Field of Classification Search
USPC ..... 362/219, 249.02, 249.13, 221, 222, 362/223, 217.1, 217.3
See application file for complete search history.

(56) References Cited

U.S. PATENT DOCUMENTS

| | | | | |
|---|---|---|---|---|
| 8,454,193 | B2 * | 6/2013 | Simon et al. | 362/217.17 |
| 2002/0060526 | A1 * | 5/2002 | Timmermans et al. | 315/246 |
| 2004/0189218 | A1 * | 9/2004 | Leong et al. | 315/291 |
| 2007/0133202 | A1 * | 6/2007 | Huang et al. | 362/235 |
| 2008/0092800 | A1 * | 4/2008 | Smith et al. | 116/202 |

* cited by examiner

*Primary Examiner* — Ali Alavi
(74) *Attorney, Agent, or Firm* — Young Basile

(57) ABSTRACT

Disclosed herein are embodiments of a LED fluorescent tube replacement lamp and lighting modules from which the lamp is constructed. One embodiment of a replacement lamp includes a plurality of interchangeable lighting modules that are configured to be electrically connected to adjacent modules. The interchangeable lighting modules can include end modules each having an end cap with pin connectors, at least one of the end modules includes electrical circuitry connected to the pin connectors for powering the modules. The lighting modules can also be center unit modules having LEDs mounted to a circuit board. The replacement lamps can be made from conceivable configurations of the lighting modules, requiring removal of only one module for repair or replacement.

20 Claims, 5 Drawing Sheets

INDEPENDENT MODULES FOR LED FLUORESCENT LIGHT TUBE REPLACEMENT

This application is a continuation of U.S. patent application No. 13/173,762, filed Jun. 30, 2011, which claims priority to U.S. Provisional Patent Application No. 61/362,504, filed Jul. 8, 2010, both of which are incorporated herein by reference in their entireties.

BACKGROUND

The present invention relates, in general, to a light emitting diode (LED) based light for replacing a conventional fluorescent light in a fluorescent light fixture and, in particular, to lighting modules that can be replaced individually.

Fluorescent tube lights are widely used in a variety of locations, such as schools and office buildings. Although conventional fluorescent bulbs have certain advantages over, for example, incandescent lights, they also pose certain disadvantages including, inter alia, disposal problems due to the presence of toxic materials within the glass tube.

LED-based tube lights which can be used as one-for-one replacements for fluorescent tube lights having appeared in recent years. One such LED-based fluorescent replacement light includes LEDs mounted on an elongated circuit board in a semi-cylindrical metal housing which also serves as a heat sink for the LEDs. A semi-circular shaped lens snaps onto the heat sink to cover the LEDs and disperse light from them. Typically, when an LED needs to be replaced or power conversion circuitry needs to be replaced, the entire light fixture may need replacement.

SUMMARY

Disclosed herein are embodiments of a LED fluorescent tube replacement lamp and lighting modules. On embodiment of a replacement lamp includes a plurality of interchangeable lighting modules that are configured to be electrically connected to adjacent modules. The interchangeable lighting modules can include end modules each having an end cap with pin connectors, at least one of the end modules including electrical circuitry connected to the pin connectors for powering the modules. The lighting modules can also include center unit modules using LEDs mounted to a circuit board. The replacement lamps can be made from conceivable configurations of the lighting modules, requiring removal of only a module for repair or replacement.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
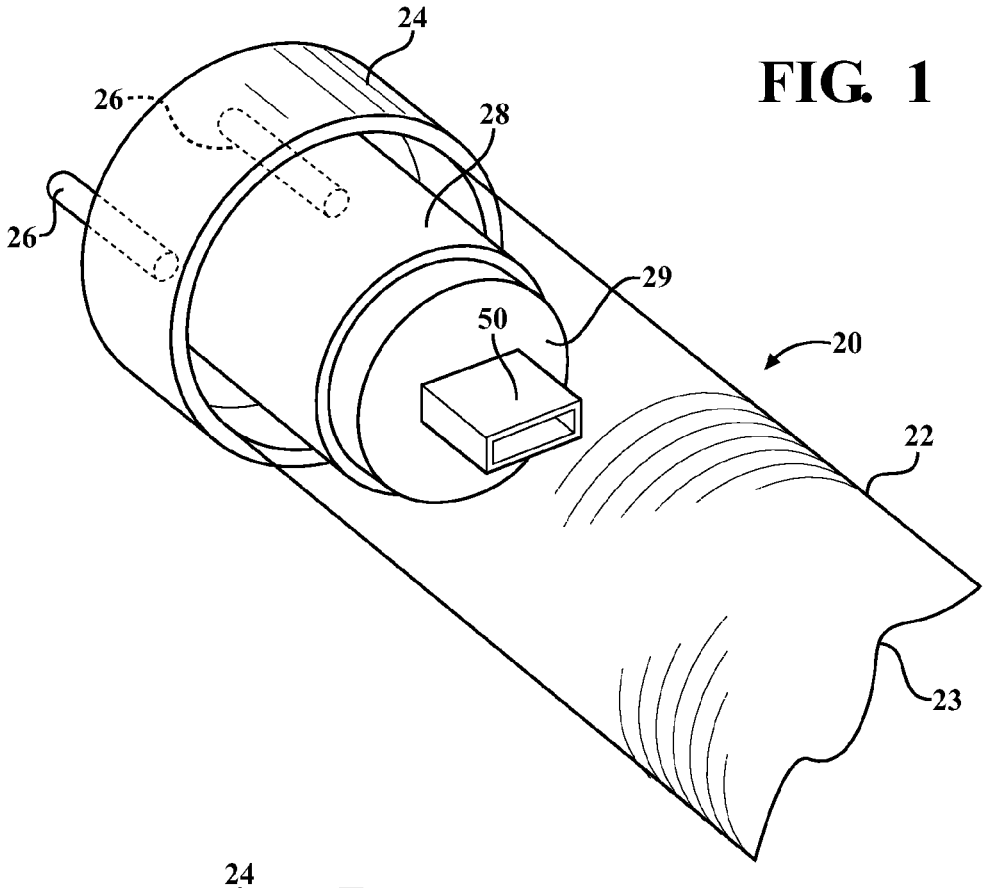
FIG. 1 is a perspective view of an embodiment of an interchangeable lighting module disclosed herein.
Figure 2:
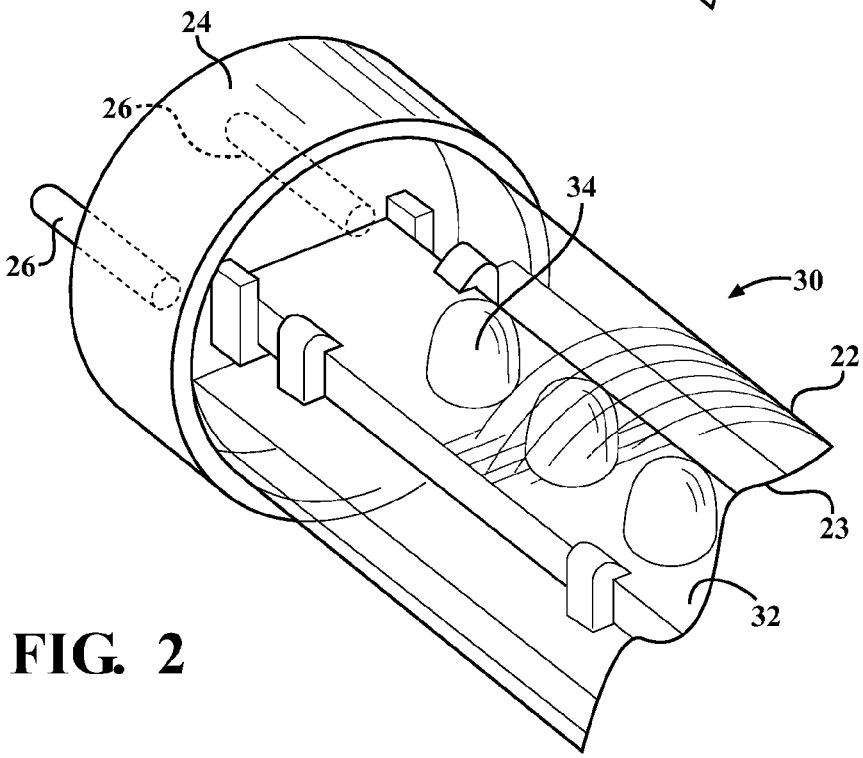
FIG. 2 is a perspective view of another embodiment of an interchangeable lighting module disclosed herein.
Figure 3:
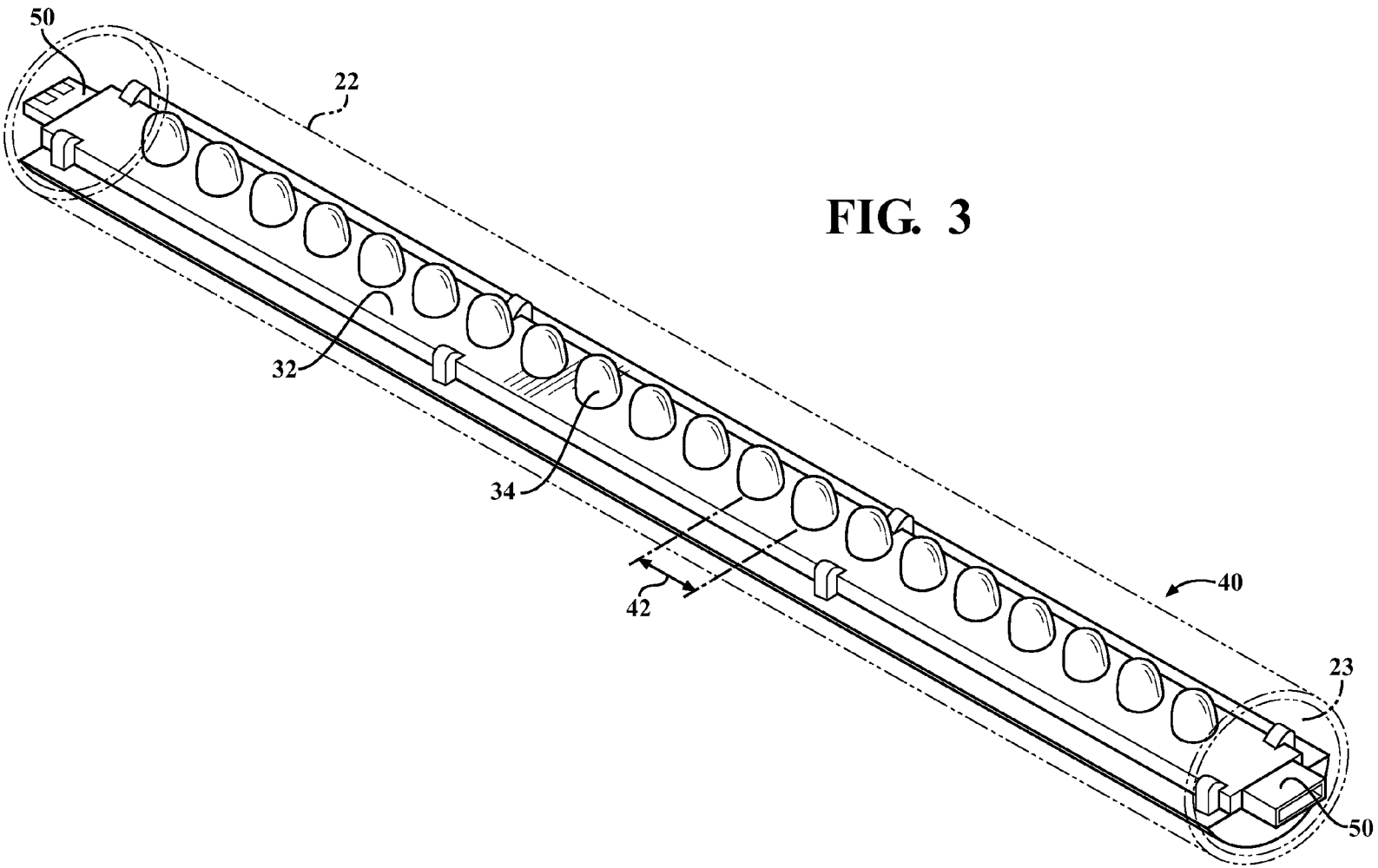
FIG. 3 is a perspective view of yet another embodiment of an interchangeable lighting module disclosed herein.

FIGS. 1-3 illustrate lighting modules according to embodiments disclosed herein. The lighting modules can each be configured with other modules so that in the aggregate the modules form an LED replacement lamp 10, shown in FIG. 4, that can be used in, for example, an existing fluorescent lamp fixture (not shown) that may have been previously used in a light system for a fluorescent lamp. The fixture can contain a ballast (not shown) which can be connected between a signal source and the replacement lamp 10.

Figure 4:
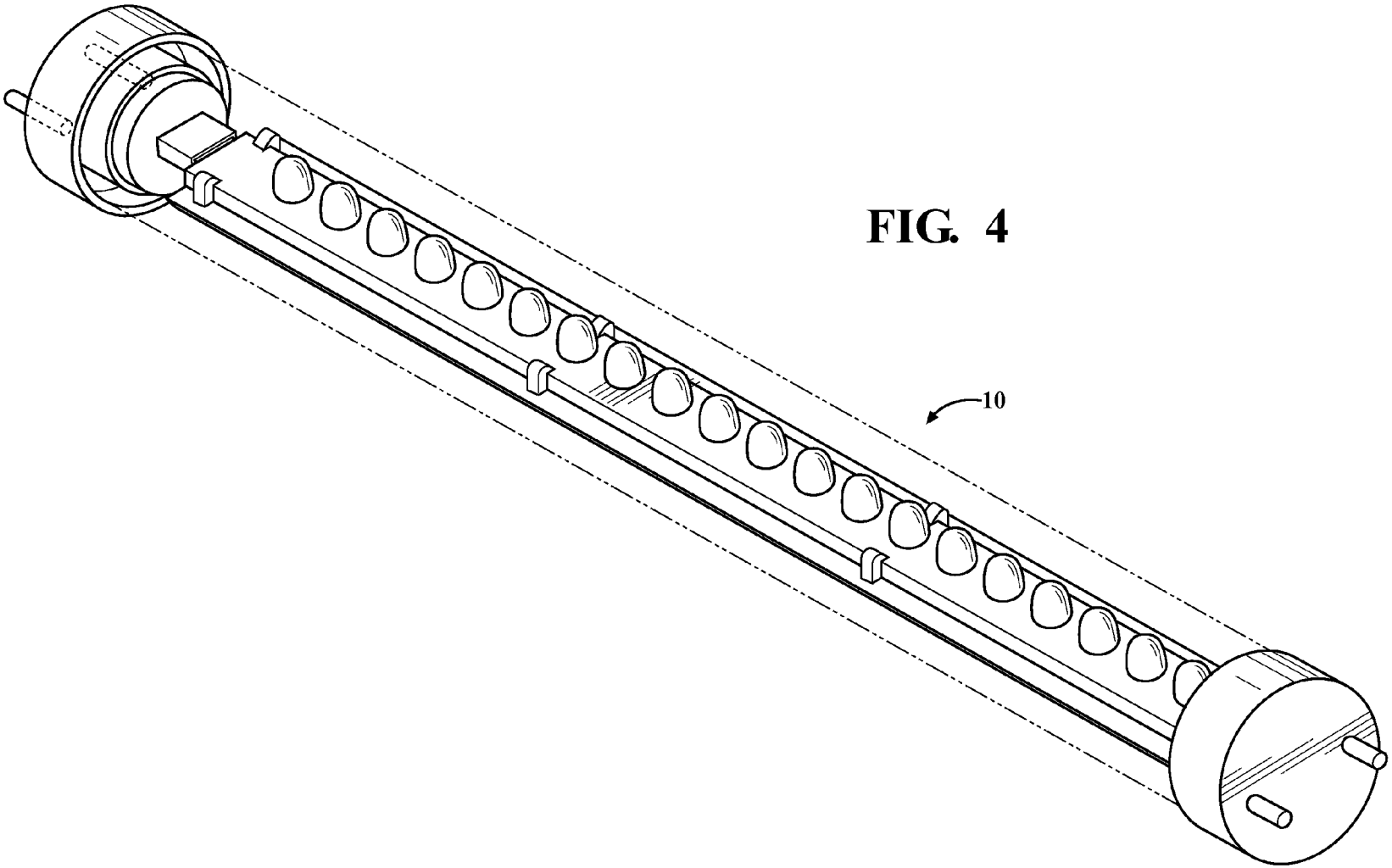
FIG. 4 is a perspective view of an embodiment of a LED replacement lamp including interchangeable lighting modules as disclosed herein.

FIG. 1 shows an embodiment of an end unit module 20 configured for use with other modules to produce the lamp 10 shown in FIG. 4. This embodiment of an end unit module 20 can include a tubular housing 22 defining a through-bore 23. The housing 22 is shown having an end cap 24 over one end of the housing 22. The end cap 24 can have two pins 26, for example, to physically and electrically connect the end unit module 20, and the aggregate lamp in which it is incorporated, to the fixture. The pins 26 can be electrically connected to a power converter 28 if needed, as shown in FIG. 1. The end 29 of the power converter 28 opposite the pins 26 has connecting means 50 for electrical connection to a circuit board of an adjacent module within the replacement lamp 10. When the end unit module 20 is in use in a replacement lamp 10, the power converter 28 provides the appropriate power to the LEDs in the replacement lamp 10.

Another embodiment of an end unit module 30 is shown in FIG. 2. In this embodiment, the end unit module 30 has a tubular housing 22 defining a through-bore 23 and having an end cap 24 as described above. The end cap 24 has two pins 26 as in the first embodiment. However, in this embodiment, the pins 26 are directly electrically connected to a circuit board 32 to provide power to LEDs 34 from the fixture. Power conversion, if needed, is done externally of the lamp. The LEDs 34 are supported by the circuit board 32 as shown in FIG. 2. The end 36 of the circuit board 32 opposite the pins 26 has connecting means 50, similar to the connecting means 50 shown in FIG. 1 or 3, such as bridge connectors, for connecting to the circuit board of an adjacent module in the replacement lamp 10.

FIG. 3 illustrates a center module 40, one or more of which can be used with one or more end unit modules 20, 30 to produce an aggregate replacement lamp 10. The center module 40 has a tubular housing 22 defining a through-bore 23 within which a circuit board 32 spans the length of the housing 22. LEDs 34 are mounted at predetermined intervals 42 along the circuit board 32. Each end of the circuit board 32 can have connecting means 50, such as bridge connectors, to connect each end unit to an adjacent center or end module as disclosed herein.

FIGS. 1-3 are provided by way of example and are not meant to be limiting. The end unit module 20 in FIG. 1, for example, could incorporate a portion of a circuit board with a number of LEDs, the portion of the circuit board being disposed in electrical connection with the power converter. The end unit module 30 of FIG. 2, for example, may only contain a portion of a circuit board with no LEDs mounted on it.

The housing 22 in any of the embodiments disclosed herein can be made from polycarbonate, acrylic, glass or another light transmitting material (i.e., the housing 22 can be transparent or translucent). For example, a translucent housing 22 can be made from a composite, such as polycarbonate with particles of a light refracting material interspersed in the polycarbonate. While the illustrated housing 22 is cylindrical, housings having a square, triangular, polygonal, or other cross sectional shape can alternatively be used. Similarly, while the illustrated housing 22 is linear, housings having an alternative shape, e.g., a U-shape can alternatively be used. Additionally, the housing 22 need not be a single piece as shown in FIGS. 1-3. Instead, another example of a housing can be formed by attaching multiple individual parts, not all of which need be light transmitting. For example, a housing 22 for a module can be formed by attaching multiple individual parts, such as an opaque lower portion and a lens or other transparent cover attached to the lower portion to cover the LEDs 34. The housing 22 as shown in FIGS. 1-3 can be manufactured to include light diffusing or refracting properties, such as by surface roughening or applying a diffusing film to the housing 22. Additionally, the housing 22 can define a groove for slidably receiving the circuit board 32 for those modules with circuit boards 32.

The circuit board 32, as illustrated in FIGS. 2 and 3, is an elongate printed circuit board. The circuit board 32 can be slidably engaged with a groove of the housing 22 or the circuit board 32 can alternatively be clipped, adhered, snap-fit or friction-fit, screwed or otherwise connected to the housing 22. For example, the circuit board 32 can be mounted on a heat sink that is attached to the housing 22. Other types of circuit boards may be used, such as a metal core circuit board. Alternately, instead of a circuit board 32, other types of electrical connections (e.g., wires) can be used to electrically connect the LEDs 34 to the power converter 28 shown in FIG. 1 or to bridge connectors described later. Additional electrical components, such as a rectifier and a filter, can also be mounted on the circuit board 32.

LEDs 34 in a center module and end unit module of a replacement lamp 10 can include at least one LED, a plurality of series-connected or parallel-connected LEDs, or an LED array. At least one LED array can include a plurality of LED arrays. Any type of LED may be used in LEDs 34. For example, LEDs can be high-brightness semiconductor LEDs, an organic light emitting diodes (OLEDs), semiconductor dies that produce light in response to current, light emitting polymers, electro-luminescent strips (EL) or the like. The LEDs 34 can be surface-mount devices of a type available from Nichia. The LEDs 34 can be mounted to the circuit board 32 by solder, a snap-fit connection, or by other means. The LEDs 34 can produce white light. However, LEDs that produce blue light, ultra-violet light or other wavelengths of light can be used in place of or with white light emitting LEDs 34. Although the embodiments will be discussed with reference to modules that solely contain LEDs, other embodiments of lighting modules do not have to be exclusively limited to LEDs. For example, other embodiments of lighting modules may contain a combination of a fluorescent lamp and LEDs.

In the embodiments of modules having end caps 24 with pins 26, one of the two pins 26 can be a "dummy pin" that does not provide an electrical connection. Alternatively, instead of pairs of pins 26 as shown, other types of electrical connectors depending on the type of fixture, can extend from the end cap 24 into the housing 14. For example, a single pin 26 can be used instead of two pins 26 for compatibility with a single pin fixture. Alternatively, both pins 26 can be "dummy pins" that do not provide an electrical connection, thereby requiring the use of such module with another end module that provides the electrical connection with the fixture.

Further, the end caps 24 may not have any pins 26 or the end caps 24 could have a plurality of pins. For example, dummy pins in number from 1-4, for example only, may be provided on one or both end caps 24. Since the pins 26 are "dummy pins" that do not provide an electrically connection, and function merely to support the assembly in a light fixture, electrical conductors may be brought into the fixture at any location, such as from the side of the fixture, for example only. An optional connector may be provided on any one or any combination of the fixture, lamp or conductors to connect the electrical conductors to the modules.

The power converter 28 can convert the power received through the fixture into power usable by and suitable for the LEDs 34. The power converter 28 can include one or more of an inrush protection circuit, a surge suppressor circuit, a noise filter circuit, a rectifier circuit, a main filter circuit, a current regulator circuit and a shunt voltage regulator circuit. The current regulator circuit can be connected to LEDs 34. The power converter 28 can be suitably designed to receive a wide range of currents and/or voltages from a power source.

The modules 20, 30, 40 can be manufactured so that a particular combination of modules forms a replacement lamp 10 such as that shown in FIG. 4. The number of modules required to complete a replacement lamp 10 is shown by way of example and is not meant to be limiting. For example, a replacement lamp 10 may be produced from two end modules such as the modules 30 of FIG. 2 or the modules 20 of FIG. 1; each further including a circuit board with LEDs. A replacement lamp 10 can be produced from two end units and one or more of a center unit 40. For compatibility with the fixture as discussed above, the modules 20, 30, 40 can have a length such that the aggregate replacement lamp 10 is approximately 48" long. Of course, the overall lamp 10 can have other suitable dimensions.

The number of LEDs 34 in an overall replacement lamp 10 can be a function of the desired power of the lamp 10 and the power of the LEDs 34. For a 48" light, the number of LEDs 34 can vary from about five to four hundred such that the lamp 10 outputs approximately 500 to 3,000 lumens. However, a different number of LEDs 34 can alternatively be used, and the lamp 10 can output a different amount of lumens. The LEDs 34 can be evenly spaced along the circuit board 32, and the spacing of the LEDs 34 can be determined based on, for example, the light distribution of each LED 34 and the number of LEDs 34. Accordingly, the modules 30, 40 having LEDs 34 will contain LEDs in a number and a spacing such that the aggregate lamp 10 will produce the required lumens output.

The modules 20, 30, 40 can be sold as an aggregate replacement lamp 10 as shown in FIG. 4 and as the individual modules. When a module of the replacement lamp 10 requires maintenance or to be replaced, the module can be removed and either replaced with a new module or repaired and replaced, leaving the other modules in the lamp 10 in tact. The ability to replace modules rather than an entire lamp reduces the cost of the using LED replacement lighting systems. The modules also make repair and maintenance easier.

Figure 5:
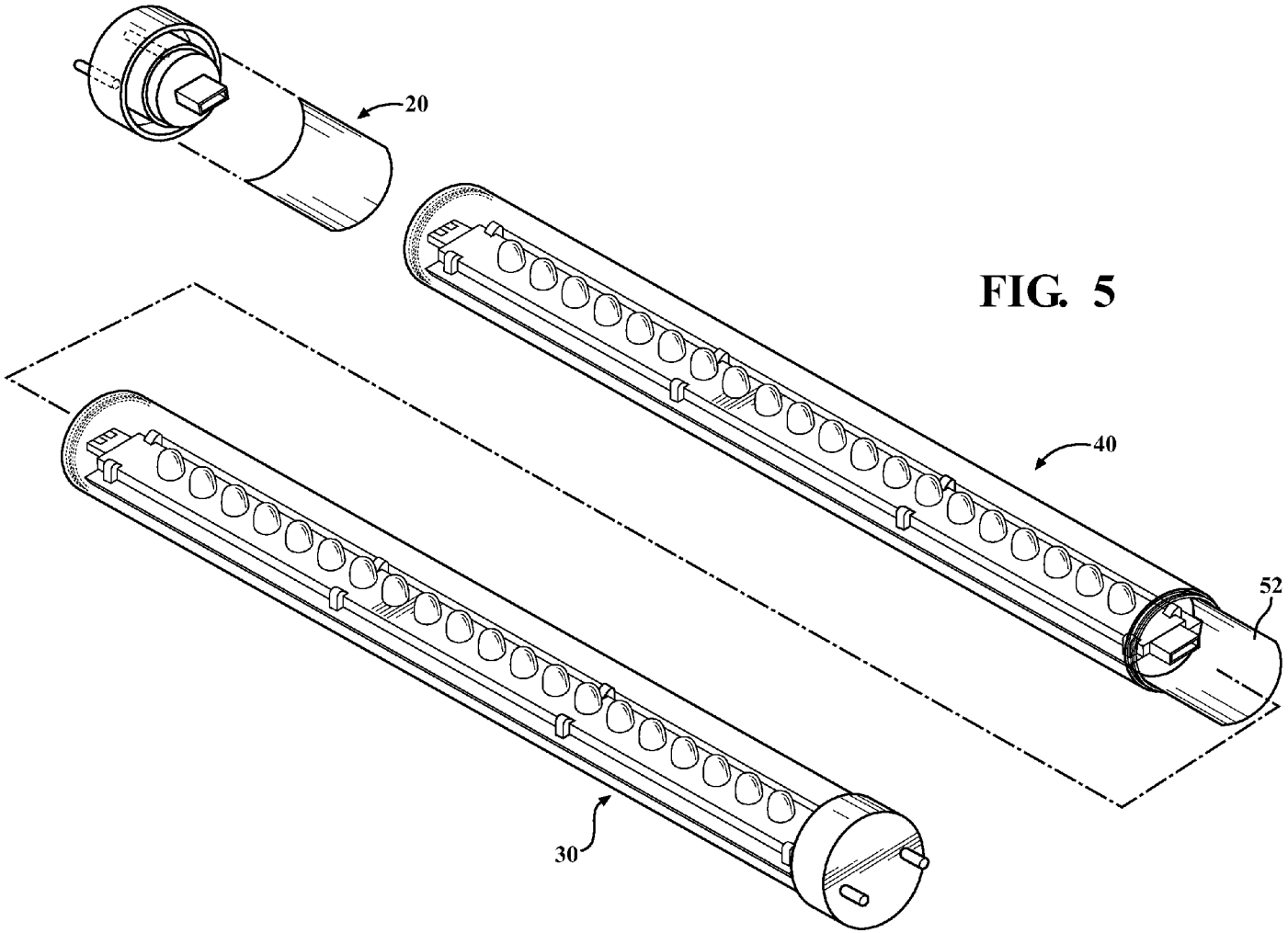
FIG. 5 is a perspective view of a support component for use with the interchangeable lighting modules disclosed herein.
Figure 6A:
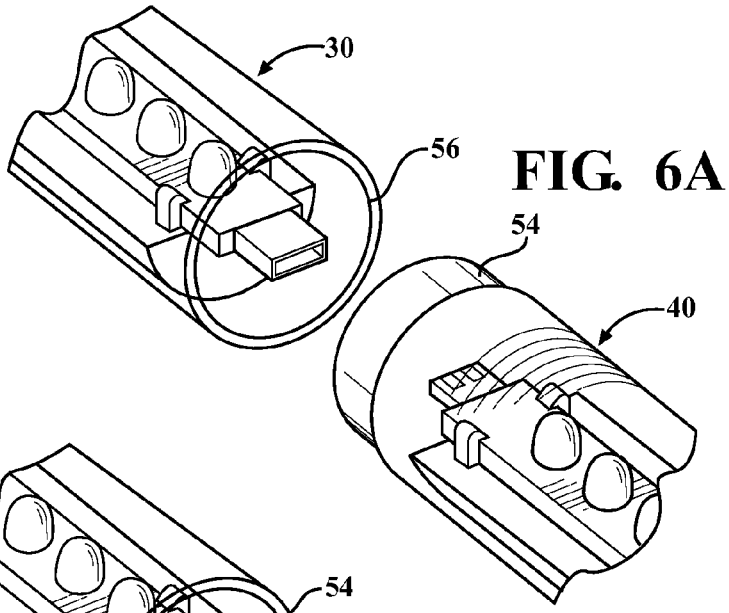
FIGS. 6A-C are perspective views of embodiments of the interchangeable lighting modules having mating ends.
Figure 6B:
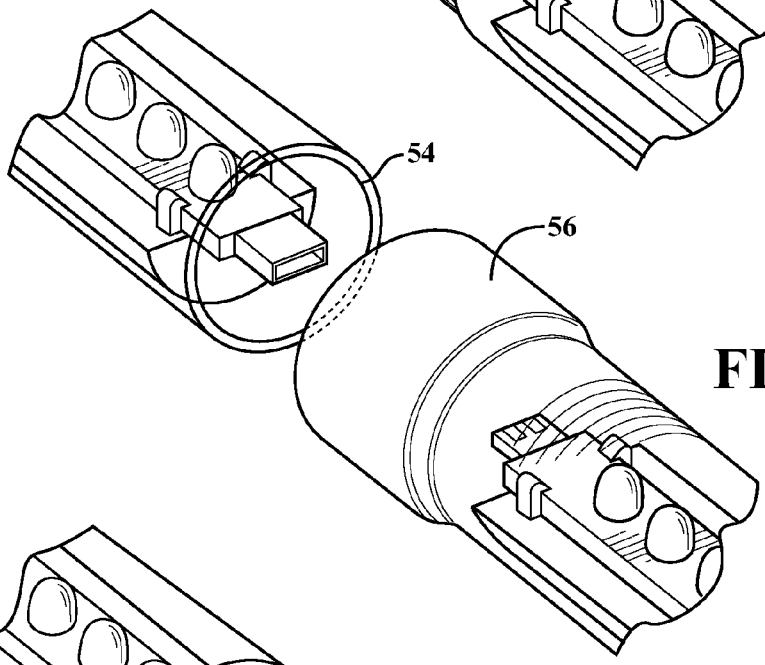
Figure 6C:
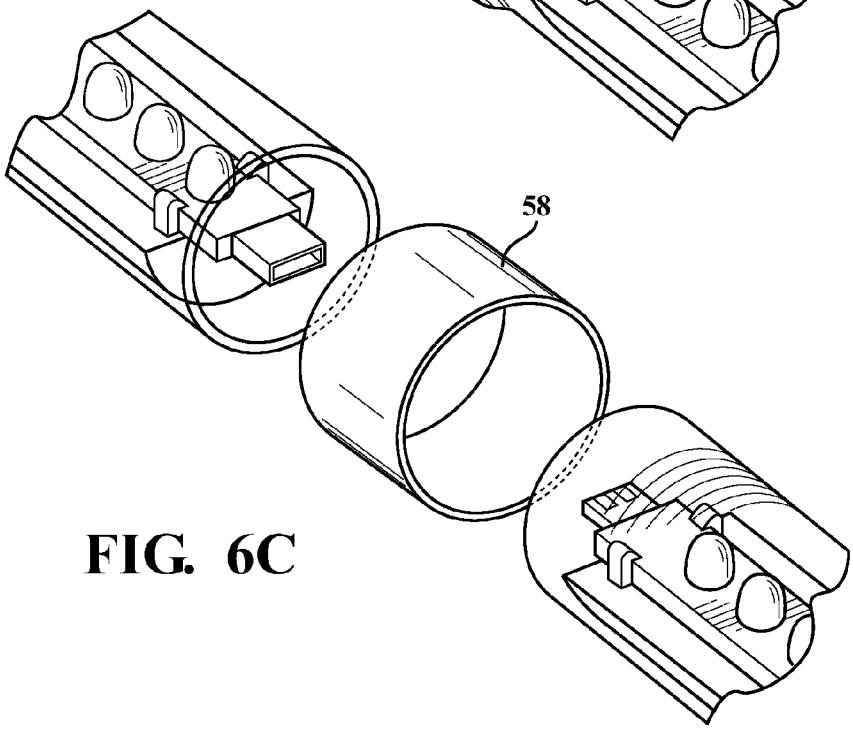

As discussed, the modules 20, 30, 40 connect one circuit board 32 to another circuit board 32 or the power converter 28 to circuit board 32 via connecting means 50, such as bridge connectors. The bridge connectors can be appropriate male and female connectors or hermaphroditic connectors. Other connecting means known to those skilled in the art are contemplated. The housing 22 of a module 20, 30, 40 can contact an adjacent housing such that the housing ends are flush. The connecting means 50 can provide sufficient support to maintain the modules 20, 30, 40 within the lamp 10. In another embodiment, the modules 20, 30, 40 may comprise a bridge support 52 shown in FIG. 5 that can either be a separate piece that snaps onto the connected circuit boards 32, spanning the connecting means 50, to reinforce the modules 20, 30, 40 within the lamp 10. It is also contemplated that the housing 22 of the modules 20, 30, 40 have mating ends as shown in FIGS. 6A-6C. In FIG. 6A, one module 20 can have a male end 54 while the adjacent module 40 can have a female end 56. FIG. 6B illustrates another example of mating ends 56, 57. These are provided by means of example and are not meant to be limiting. Other configurations can be used that produce a similar result.

In FIG. 6C, a separate sleeve 58 can be provided with a module that is configured so that adjacent ends 56 of modules frictionally slide into opposing ends of the sleeve 58. The sleeve 58 can provide additional support to the lamp 10 where the modules connect. The sleeve 58 can be made of the same material as the housing 22 so that it is less noticeable to the naked eye when the lamp 10 is in use.

To prevent shock that can occur if a module 20, 30, 40 is removed while the lamp 10 is in the fixture, the modules will fit together such that a module cannot be removed unless the aggregate lamp 10 is removed from the fixture. It is also contemplated that the modules 20, 30, 40 can be configured such that the mechanical interface between adjacent modules has a mechanical safety feature to prevent electrical shock. For example, the mechanical interface can have a locking mechanism to prevent the modules from becoming decoupled; where the recharging interface can only be unlocked if the entire replacement lamp 10 is removed from the light fixture. When the lamp 10 is removed from the fixture, the power source is decoupled.

The independent modules 20, 30, 40 can be configured such that the electrical circuitry in the end modules 20, 30, i.e. the pin 26 connection, the power converter 28 or the circuit board 32, will prevent the flow of electricity from the power source to the modules unless the power circuitry senses an appropriate circuit resistance between the ends. For example, the electrical circuitry will not operate until it senses that no connecting means 50 remains unconnected.

The independent modules containing the power converter 28, such as module 20, can be configured to operate across a range of power draws, such that upgrading to more efficient LEDs requires the replacement of only certain modules, such as the center module 40. It is also contemplated that modules containing LEDs can be removed so that the individual LEDs can be replaced within a module. The module with the updated LEDs can than be reinstalled with existing end modules to form an updated replacement lamp 10.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A LED fluorescent tube replacement lamp comprising:

a plurality of interchangeable lighting modules, wherein adjacent modules are electrically connected, the plurality of interchangeable lighting modules including:

two end modules each including an end cap with at least one end connector, at least one of the end modules including electrical circuitry connected to the at least one end connector for powering the end modules; and at least one center module including electrical circuitry; and wherein any one of the two end modules and the at least one center module is manually separable from an adjacent module and replaceable with a like module.

2. The lamp of claim 1 further comprising:

at least one another connector providing an electrical connection to the at least one center module.

3. The lamp of claim 1 wherein:

the at least one end connector on at least one of the end caps includes two connectors.

4. The lamp of claim 2 further comprising:

the electrical circuitry in the at least one center module includes a circuit board with at least one electrically connected LED; and the at least another connector electrically connects the at least one end cap to the circuit board in the at least one center module.

5. The lamp of claim 1 wherein:

the two end modules and the at least one center module are replaceably electrically connected.

6. The lamp of claim 1 further comprising:

a bridge connector, wherein the bridge connector electrically connects adjacent of the two end modules and the at least one center module and mechanically couples the adjacent of the two end modules and the at least one center module in a manually separable connection.

7. The lamp of claim 1 wherein:

the electrical circuitry in at least one of the end modules includes a power converter.

8. The lamp of claim 1 further comprising:

a housing coupled between the two end modules and encompassing the at least one center module.

9. An interchangeable end module for an LED fluorescent tube replacement lamp connectable to another interchangeable lighting module, comprising:

a housing, an end cap mounted in one end of the housing and having at least one end connector, and electrical circuitry connected to the at least one end connector for powering the LED fluorescent tube replacement lamp;

wherein the end module is connectable to a center module, the end module and the center module configured to be coaxially arranged with adjacent ends of the end module and the center module joined into a unitary housing; and wherein the end module is replaceable with a like module.

10. The end module of claim 9, wherein the center module includes a housing encompassing a circuit board and at least one LED mounted on the circuit board.

11. The end module of claim 9, wherein the center module includes bridge connectors coupled to opposing ends of the circuit board for separable connection to adjacent light modules.

12. The end module of claim 9, wherein the end module and the center module are replaceably electrically connected.

13. The end module of claim 9, wherein the electrical circuitry in the end module includes a power converter.

14. The end module of claim 9, wherein the unitary housing is one of a translucent and transparent, cylindrical housing.

15. An interchangeable center module for an LED fluorescent tube replacement lamp connectable to another interchangeable lighting module, comprising:

a housing encompassing a circuit board and at least one LED mounted on the circuit board;

wherein the center module is connectable to an end module, the center module and the end module configured to be coaxially arranged with adjacent ends of the center module and the end module joined into a unitary housing; and wherein the center module is replaceable with a like module.

16. The center module of claim 15, further comprising:

bridge connectors coupled to opposing ends of the circuit board for separable connection to adjacent light modules.

17. The center module of claim 15, wherein the end module and the center module are replaceably electrically connected.

18. The center module of claim 15, wherein the electrical circuitry in the end module includes a power converter.

19. The center module of claim 15, wherein the like module contains an LED that is of a different type than the at least one LED.

20. The center module of claim 9, wherein the unitary housing is one of a translucent and transparent and a cylindrical housing.

* * * * *